US012345483B2

(12) United States Patent
Hastey et al.

(10) Patent No.: US 12,345,483 B2
(45) **Date of Patent: *Jul. 1, 2025**

(54) FLEXIBLE TUBE CLEANING LANCE POSITIONER FRAME APPARATUS

(71) Applicant: STONEAGE, INC., Durango, CO (US)

(72) Inventors: Matthew B. Hastey, Durango, CO (US); Cody R. Montoya, Aztec, NM (US); Joseph A. Schneider, Durango, CO (US)

(73) Assignee: STONEAGE, INC., Durango, CO (US)

( * ) Notice: Subject to any disclaimer, the term of this patent is extended or adjusted under 35 U.S.C. 154(b) by 4 days.

This patent is subject to a terminal disclaimer.

(21) Appl. No.: 18/228,279

(22) Filed: Jul. 31, 2023

(65) Prior Publication Data

US 2024/0027149 A1 Jan. 25, 2024

Related U.S. Application Data

(63) Continuation of application No. 16/996,689, filed on Aug. 18, 2020, now Pat. No. 11,713,932.

(51) Int. Cl.
*F28G 1/16* (2006.01)
*F28G 15/02* (2006.01)

(52) U.S. Cl.
CPC ..... *F28G 1/163* (2013.01); *F28G 15/02* (2013.01)

(58) Field of Classification Search
None
See application file for complete search history.

(56) References Cited

U.S. PATENT DOCUMENTS 3,836,015 A * 9/1974 Travis ..... B66C 1/00 29/726.5
4,050,384 A * 9/1977 Chapman ..... F28G 15/02 73/866.5

(Continued)

FOREIGN PATENT DOCUMENTS

CN 102135391 A * 7/2011
CN 102305574 A * 1/2012

(Continued)

OTHER PUBLICATIONS

CN102135391 A English Machine Translation (Year: 2011).*

(Continued)

*Primary Examiner* — Jenna M Maroney
(74) *Attorney, Agent, or Firm* — Stephen Y. Liu; Carstens, Allen & Gourley, LLP

(57) ABSTRACT

A frame apparatus for holding a flexible lance positioning drive device adjacent to and spaced from a heat exchanger tube sheet includes an upper guide rail carrying a movable carriage supporting a drive positioner rail having a drive support carriage and an air motor drive assembly fastened to each of the carriages, each air motor drive assembly comprising an air motor having a shaft driving a spur gear through a worm gear reducer, wherein the spur gear is carried within a spur gear housing fastened to the worm gear reducer, and the air motor assembly is fastened to the carriage via the spur gear housing. The spur gear housing is selectively rotatable on the carriage between a locked position with the spur gear engaging the rail to which the carriage is mounted and an unlocked position with the spur gear disengaged with the rail to which the carriage is mounted.

17 Claims, 8 Drawing Sheets

(56) References Cited

U.S. PATENT DOCUMENTS

| | | | | |
|---|---|---|---|---|
| 4,095,305 | A * | 6/1978 | Goodwin | F28G 3/10 15/104.095 |
| 9,610,603 | B2 * | 4/2017 | Wright | B08B 3/024 |
| 10,024,613 | B2 * | 7/2018 | Mathis | F28G 15/02 |
| 10,684,082 | B2 * | 6/2020 | Mathis | F28G 15/02 |
| 10,780,628 | B2 * | 9/2020 | Padgett | B29C 64/232 |
| 11,454,466 | B2 * | 9/2022 | Kim | F28G 1/163 |
| 11,713,932 | B2 * | 8/2023 | Hastey | F28G 15/04 134/22.12 |
| 2006/0249185 | A1 * | 11/2006 | Garman | B08B 9/0433 134/167 C |
| 2011/0000643 | A1 * | 1/2011 | Kim | F28G 15/02 165/95 |
| 2012/0067370 | A1 * | 3/2012 | Crock | F28G 3/163 134/6 |
| 2016/0025432 | A1 * | 1/2016 | Mathis | F16L 3/223 248/68.1 |
| 2016/0025433 | A1 * | 1/2016 | Mathis | F28G 15/02 269/1 |
| 2016/0096202 | A1 * | 4/2016 | Zink | F28G 1/163 |
| 2016/0144564 | A1 * | 5/2016 | Padgett | B29C 64/209 425/113 |
| 2016/0243597 | A1 * | 8/2016 | Shawver | F28G 15/02 |
| 2017/0108300 | A1 * | 4/2017 | Brumfield | B08B 9/0325 |
| 2017/0356702 | A1 * | 12/2017 | Gromes, Sr. | B24C 7/0015 |
| 2018/0266777 | A1 * | 9/2018 | Krauser | F28G 1/163 |
| 2018/0292151 | A1 * | 10/2018 | Mathis | F28G 3/163 |
| 2020/0132402 | A1 * | 4/2020 | Schneider | F28G 15/003 |
| 2020/0263941 | A1 * | 8/2020 | Schneider | F28G 9/00 |
| 2021/0207903 | A1 * | 7/2021 | Gromes, Sr. | F28G 15/06 |

FOREIGN PATENT DOCUMENTS

| | | | | |
|---|---|---|---|---|
| EP | 2034266 | A2 * | 3/2009 | F28G 1/166 |
| GB | 2031101 | A * | 4/1980 | F23J 3/00 |
| WO | 2016014626 | A1 | 1/2016 | |
| WO | WO-2020218661 | A1 * | 10/2020 | F28G 15/003 |
| WO | WO-2021085728 | A1 * | 5/2021 | F28G 1/163 |

OTHER PUBLICATIONS

European Opposition No. OP193401EP00 filed Sep. 28, 2023 regarding European Patent No. EP 3957944, issued on Dec. 28, 2022, Application No. 21181855.4, filed on Jun. 25, 2021 along with the exhibits.

European Opposition No. OP195967EP00 filed May 2, 2024 regarding European Patent No. EP 4187192, issued on Mar. 20, 2024, Application No. 22216434.5 filed on Dec. 23, 2022 along with the exhibits.

* cited by examiner

FLEXIBLE TUBE CLEANING LANCE POSITIONER FRAME APPARATUS

CROSS-REFERENCE TO RELATED APPLICATIONS

This application is a continuation application of co-pending U.S. patent application Ser. No. 16/996,689 entitled "Flexible Tube Cleaning Lance Positioner Frame Apparatus" filed Aug. 18, 2020, the technical disclosure of which is hereby incorporated by reference in its entirety.

BACKGROUND OF THE DISCLOSURE

The present disclosure is directed to high pressure fluid rotary nozzle systems. In particular, embodiments of the present disclosure are directed to an apparatus for positioning one or more flexible tube cleaning lances in registry with a heat exchanger tube sheet.

Conventional lance positioner frames are heavy rigid frame structures that can be assembled adjacent a heat exchanger once the tube sheet flange cover has been removed. Alternatively such frame assemblies can be bolted to the tube sheet directly. U.S. Pat. Nos. 4,095,305, 6,626,195, 6,681,839, and 7,530,363 disclose exemplary rectilinear frames adapted to be positioned adjacent or fastened to a heat exchanger tube sheet. Such assemblies are heavy, generally awkward to set up and utilize, and most require a substantial amount of space adjacent to or in line with the tube sheet which may limit the feasibility of using such assemblies. An apparatus for precisely positioning one or more cleaning lances in registry with a heat exchanger tube sheet that is simple to erect, remains rigid, and takes up minimal space adjacent the tube sheet is disclosed in our U.S. Pat. Nos. 10,024,613 and 10,684,082. In order to make a lightweight lance positioner frame more convenient and efficient to erect and use, further refinements are needed.

SUMMARY OF THE DISCLOSURE

The present disclosure directly addresses such needs. One embodiment of a frame apparatus for precisely holding and positioning a flexible lance drive adjacent to and spaced from a heat exchanger tube sheet in accordance with the present disclosure includes at least an upper guide rail and a positioner rail supported from the upper guide rail and may be guided by a lower guide rail, and a rail clamp assembly fastened to a portion of a tube sheet such as disclosed in our patents referenced above. This rail clamp assembly operably holds one of the upper and lower guide rails in a fixed position with respect to the tube sheet.

A frame apparatus in accordance with an exemplary embodiment of the present disclosure for holding a flexible lance positioning and drive device adjacent to and spaced from a heat exchanger tube sheet may be viewed as an apparatus including an upper guide rail, a lower guide rail and a positioner support rail supported from one of the upper and lower guide rails and guided by the other of the upper and lower guide rails. A positioner support rail carriage is movably mounted on the one of the upper and lower guide rails. A flexible lance drive support carriage is movably mounted on the positioner support rail. An air motor drive assembly is fastened to each of the positioner support rail carriage and the lance drive support carriage. This air motor drive assembly includes an air motor having a shaft driving a spur gear through a worm gear reducer. The spur gear is carried within a spur gear housing fastened to the worm gear reducer. The air motor assembly is fastened to the carriage via the spur gear housing and the spur gear housing is selectively rotatable on the carriage between a locked position with the spur gear engaging the rail to which the carriage is mounted and an unlocked position with the spur gear disengaged with the rail to which the carriage is mounted.

The air motor shaft may preferably be coupled to a sensor sensing rotary position of the air motor shaft from which spur gear position and hence carriage position on the one of the guide rails may be calculated. The air motor shaft is connected to a multi pole magnetic ring carried within a sensor housing fastened between the air motor and the worm gear reducer. The sensor may include a step shaft carrying a multipole magnetic ring within the sensor housing fastened between the air motor and the worm gear reducer and preferably also includes a detector fastened to the sensor housing. The detector includes a hall effect transducer configured to transmit pole reversals sensed from the multipole magnetic ring.

The apparatus preferably may include a first U shaped bracket or block fastened to the carriage and a second U shaped block fastened to the carriage. The first and second U shaped blocks are spaced apart to receive the spur gear housing therebetween, with each block receiving a corner portion of the spur gear housing therein. Each one of the first and second U shaped blocks has a first cross bore therethrough carrying a pin through the corner portion of the spur gear housing therein. One of the first and second U shaped blocks has a second cross bore therethrough spaced above the first cross bore and the pin through the first cross bore in that block is removable to permit the spur gear housing to be rotated about the other U shaped block. The removable pin can be inserted through the second cross bore thereby lifting the spur gear out of engagement with the rail to which the carriage is mounted. In some embodiments, the spur gear housing has a side cover adapted prevent entry of debris into the spur gear during operation of the assembly.

An embodiment in accordance with the present disclosure may alternatively be viewed as a frame apparatus for holding a flexible lance drive device adjacent to and spaced from a heat exchanger tube sheet. The apparatus includes an upper guide rail, a lower guide rail, a positioner support rail supported from one of the upper and lower guide rails and guided by the other of the upper and lower guide rails, and a positioner support rail carriage movably mounted on the one of the upper and lower guide rails. A flexible lance drive support carriage is movably mounted on the positioner support rail. An air motor drive assembly is fastened to each of the positioner support rail carriage and the lance drive support carriage. Each air motor drive assembly includes an air motor having a shaft carrying a rotational position sensor thereon and driving a spur gear through a worm gear reducer. The spur gear is carried within a spur gear housing fastened to the worm gear reducer. The air motor assembly is preferably rotatably fastened to the carriage via the spur gear housing and the spur gear housing is selectively rotatable on the carriage between a locked position with the spur gear engaging the rail to which the carriage is mounted and an unlocked position with the spur gear disengaged with the rail to which the carriage is mounted. When unlocked, this configuration permits the carriage to be rolled onto the guide rail from one end of the guide rail and positioned for initial use and the air motor assembly then locked in position with the spur gear teeth in full engagement with the ladder like openings in the guide rail.

The rotational position sensor includes a multipole magnetic ring mounted on a step shaft rotated by the air motor. The rotational position sensor is supported in a sensor housing between the air motor and the worm gear reducer. The rotational position sensor further includes a hall effect detector fastened to the sensor housing.

An air motor drive assembly in accordance with the present disclosure is preferably for use on a lance positioner frame apparatus having an upper guide rail supporting a positioner support rail carriage and a lance positioner drive rail carrying a lance drive support carriage. The air motor drive assembly includes an air motor having a shaft driving a spur gear through a worm gear reducer. The spur gear is carried within a spur gear housing fastened to the worm gear reducer. The spur gear housing is selectively rotatable, on either one of the carriages, between a locked position with the spur gear engaging the rail to which the one of the carriages is mounted and an unlocked position with the spur gear disengaged with the rail to which the one of the carriages is mounted. This assembly further preferably includes each of the carriages having a first U shaped block fastened thereto and a second U shaped block fastened thereto each receiving a corner portion of the spur gear housing therein. Each one of the first and second U shaped blocks has a first cross bore therethrough carrying a pin through the corner portion of the spur gear housing therein. One of the first and second U shaped blocks has a second cross bore therethrough spaced above the first cross bore and the pin through the first cross bore is removable to permit the spur gear housing to be rotated about the other U shaped block until the removable pin can be inserted through the second cross bore thereby lifting the spur gear out of engagement with the rail to which the carriage is mounted.

Preferably a rotational sensor housing is fastened between the air motor and the worm gear reducer and the air motor has a step shaft carrying a multipole magnetic ring within the sensor housing. A hall effect detector is fastened to the sensor housing so as to be adjacent to the multipole magnetic ring. An electrical connector is in turn removably fastened to the hall effect detector for sending the detected signals to an appropriate processor for signal processing.

The multipole magnetic ring in this embodiment carries 24 poles providing 24 pole reversal transitions. Since the air motor rotates at a high speed, and the worm gear reducer has a known pitch and reduction ratio, and further the spur gear has a defined number of teeth engaging the ladder like slots in the guide rail, each pole reversal transition can be very precisely converted into a travel position of the carriage on the guide rail. Since the guide rail position with respect to the tube face is precisely known, the travel position of the carriage can be precisely fixed via the pole reversal transitions of the air motor shaft.

Further features, advantages and characteristics of the embodiments of this disclosure will be apparent from reading the following detailed description when taken in conjunction with the drawing figures.

DETAILED DESCRIPTION

Figure 1:
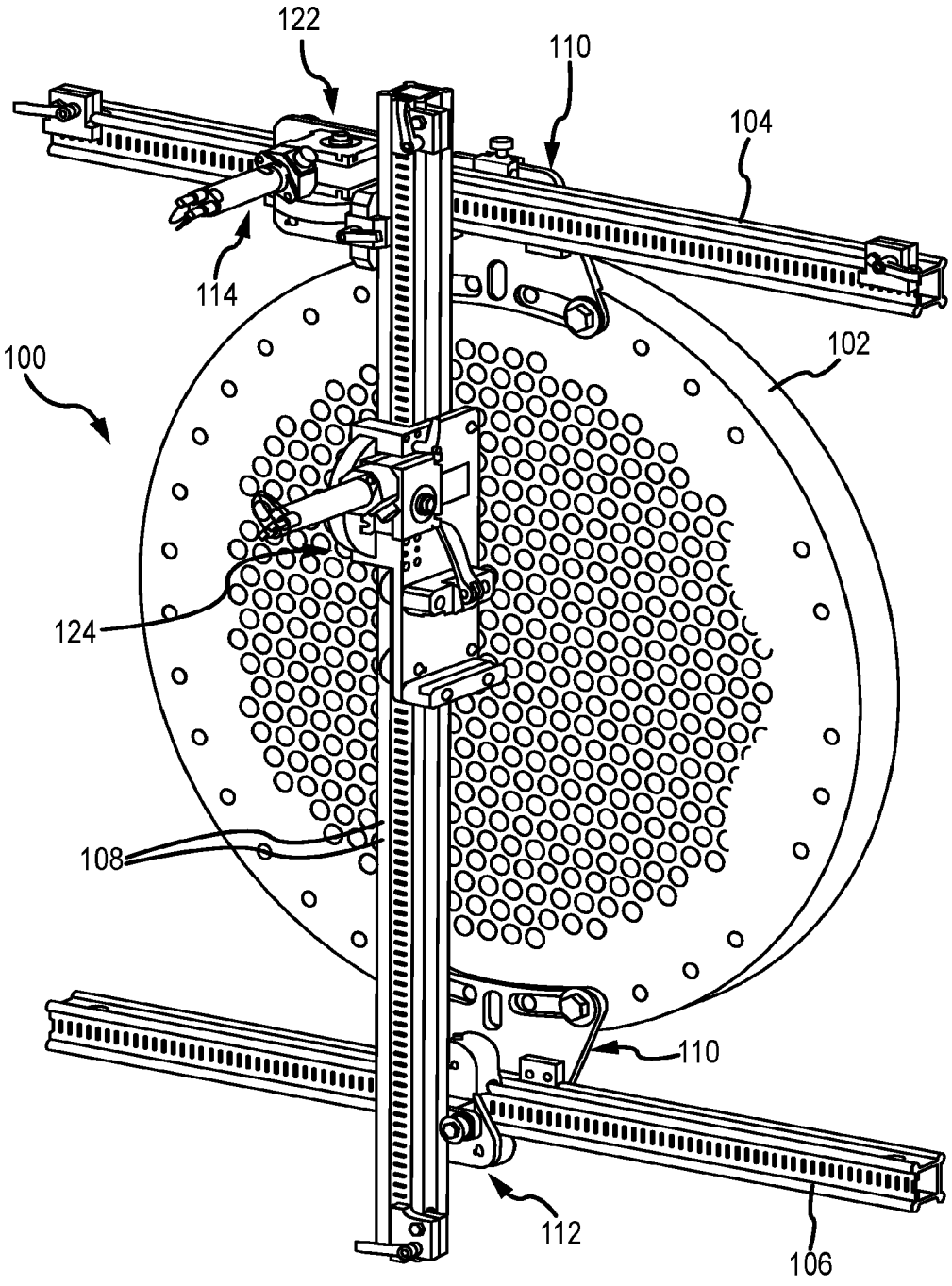
FIG. 1 is a perspective view of an exemplary embodiment of a flexible lance positioner frame apparatus in accordance with the present disclosure oriented against and fastened to an exemplary heat exchanger tube sheet.

An exemplary frame apparatus 100 in accordance with the present disclosure is shown in FIG. 1, fastened to a heat exchanger tube sheet 102. The apparatus 100 has an upper generally horizontal guide rail 104, a lower guide rail 106, and a vertical positioner support rail 108 that supports a flexible lance positioner drive carriage 124. The upper guide rail 104 serves to provide precise mechanical alignment with rows of tubes present in the heat exchanger bundle. The upper guide rail 104 carries a positioner support rail carriage 122 for back and forth movement along the upper guide rail 104. The positioner support rail carriage 122 in turn supports the positioner support rail 108 for movement of the positioner support rail 108, in FIG. 1, horizontally back and forth in a parallel plane over the tube sheet 102.

The positioner support rail 108 carries a flexible lance positioner drive carriage 124. When so aligned, the carriage 124, separately shown in FIGS. 3A and 3B, can be moved up and down along the support rail 108 to position a flexible lance drive apparatus (not shown) at precise positions in line with selected tube penetrations through the tube sheet 102. The lower guide rail 106 does not have to be installed precisely parallel to the upper guide rail 104 as the lower guide rail follower roller carriage assembly 112 can tolerate reasonable rotation within a plane roughly parallel to the face of the tube sheet 102. The lower guide rail 106 and lower guide rail follower carriage assembly 112 serve to mechanically support the carriage 124 in position and prevent deflection of the carriage 124 away axially from the tube sheet 102 generated by jet thrust, machine mass or force imparted to the system by the interaction between the flexible lance drive assembly (not shown) fastened to the carriage 124, the flexible lance(s) and the heat exchanger tubes.

Each of the upper and lower guide rails 104 and 106 is each fastened to the tube sheet 102 via, for example, a clamp plate assembly 110 such as is shown in more detail in our U.S. Pat. Nos. 10,024,613 and 10,684,082 mentioned above.

Figure 2:
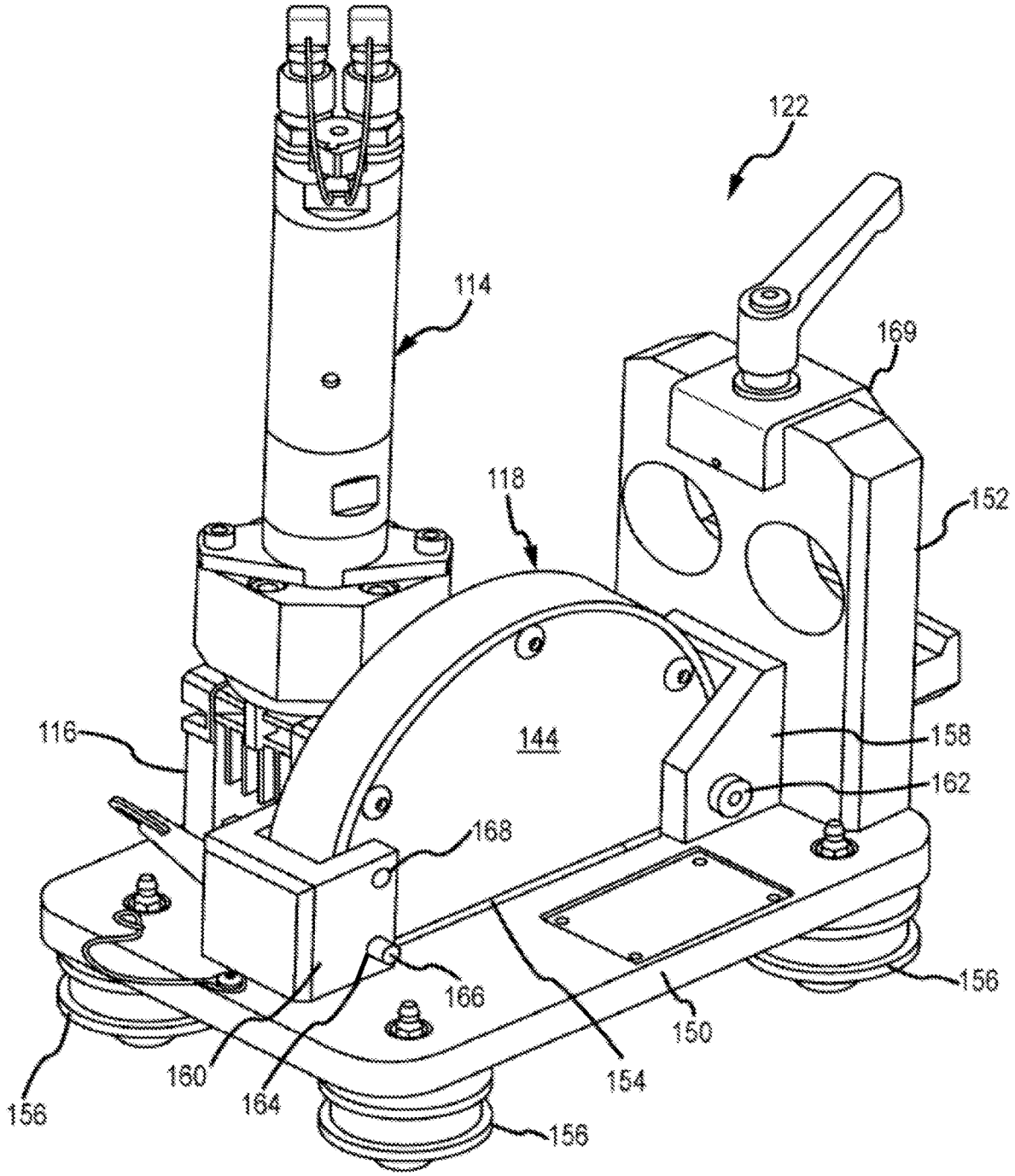
FIG. 2 is a separate perspective view of a positioner support rail carriage assembly in accordance with the present disclosure.

The positioner support rail carriage 122, separately shown in FIG. 2, is remotely operated to move the support rail 108 back and forth along the upper guide rail 104. It is to be understood that the above configuration may be reversed, with the positioner support rail carriage 122 mounted on the lower guide rail 106 and the follower roller assembly 112 mounted on the upper guide rail 104. In such a case, the alignment of the lower guide rail 106 with respect to the tube penetrations through the tube sheet 102 would be critical.

Each of the upper guide rail 104, the lower guide rail 106, and the positioner support rail 108 shown in FIG. 1 is preferably an aluminum box rail extrusion having, in cross section, a generally rectangular tube shape having four side walls. Each of the four corners of the rail extrusion extends outward to form an axially extending external rib. Preferably at least one of the side walls of each guide rail has a series of spaced closed slots forming essentially a ladder surface that is designed to operably engage with a spur gear 120 driven by one of the air motors 126 in the carriages 122 or 124 described in more detail below. The external parallel ribs on each of the rails 104, 106, and 108 engage support rollers on the carriages 122, 124 and follower roller assembly 112.

Figure 6:
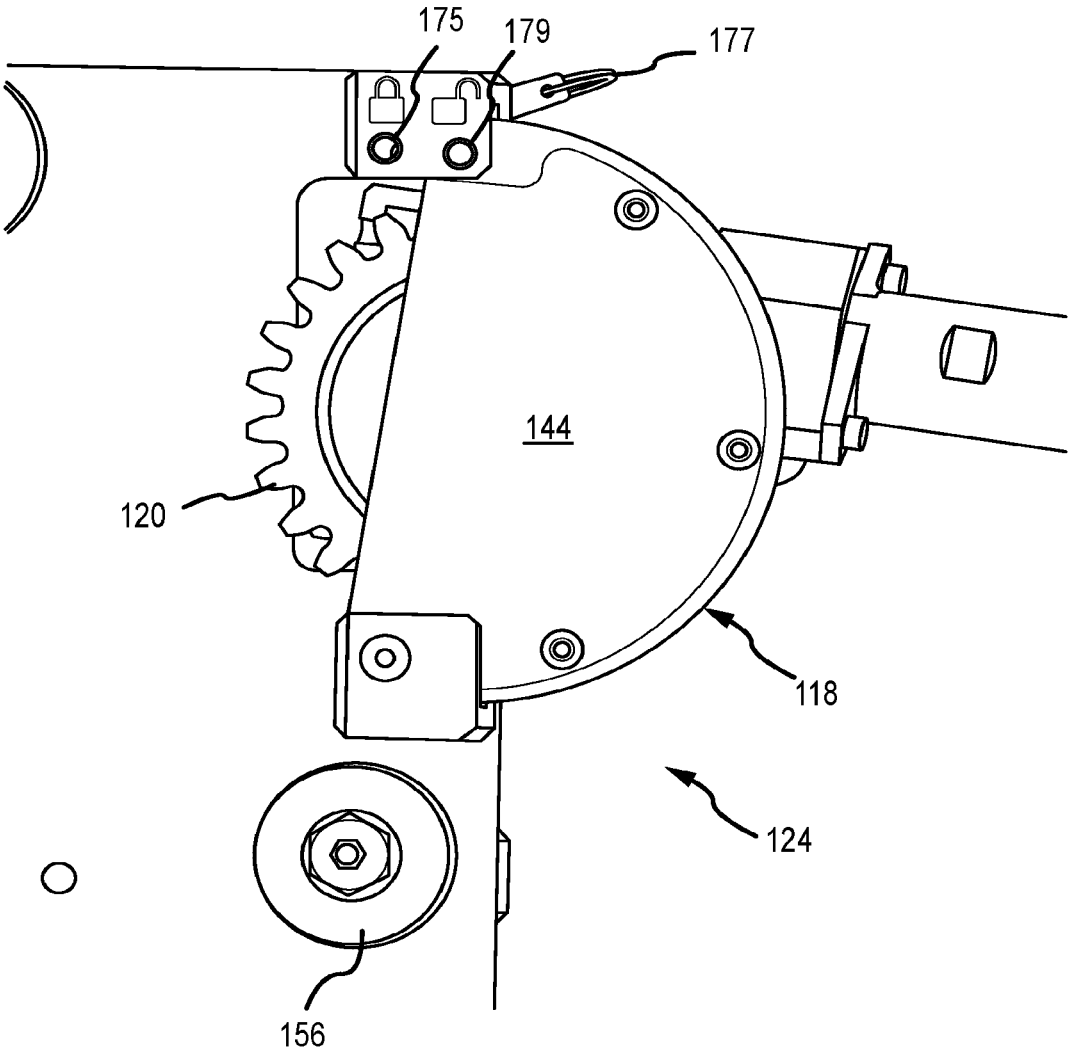
FIG. 6 is a side view of the lance positioner drive carriage shown in FIG. 3A with the air motor drive assembly in the unlocked position.
Figure 7:
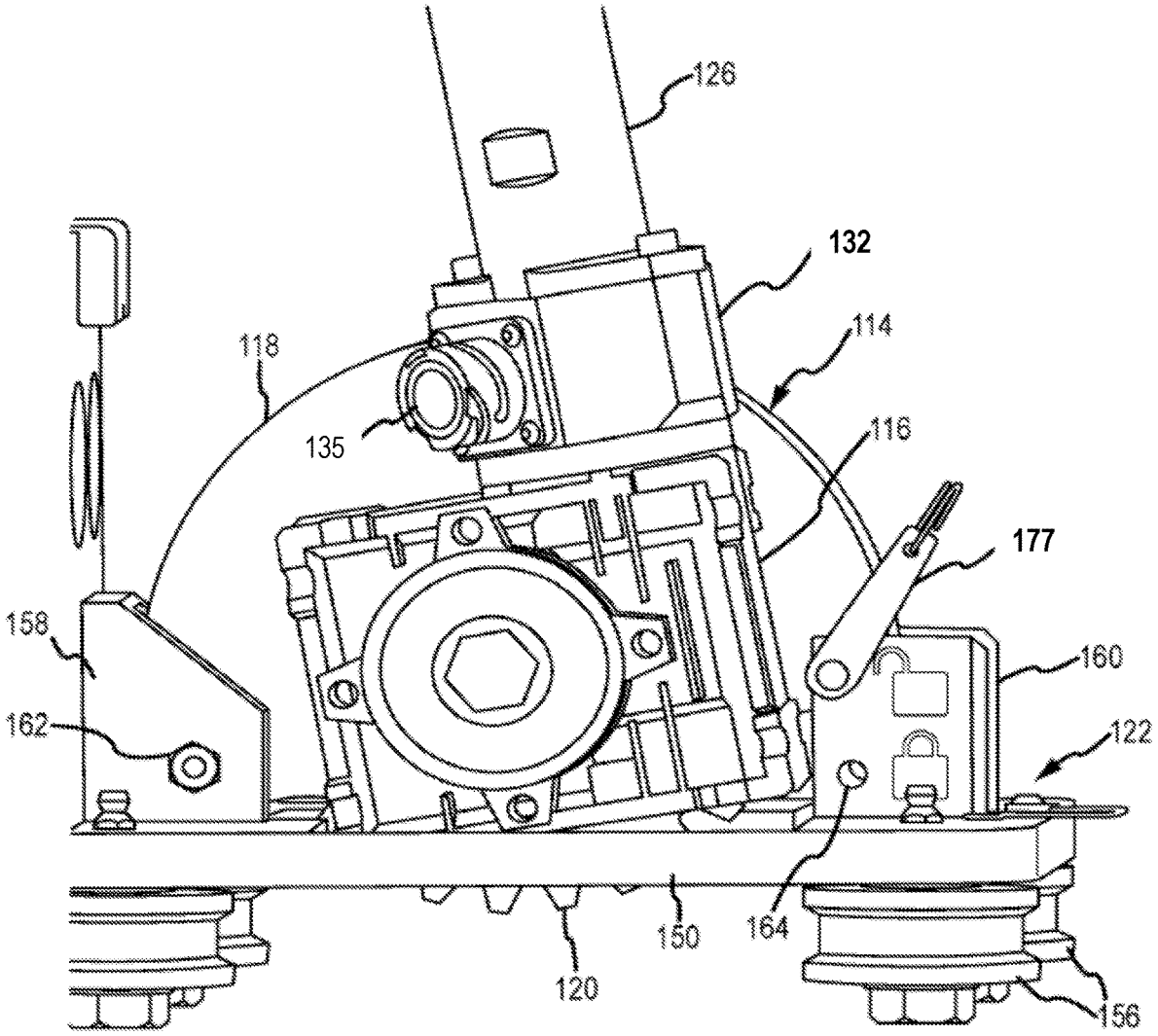
FIG. 7 is a partial side view of the positioner support rail carriage showing the air motor drive assembly in the unlocked position.

Each of the carriages 122 and 124 has a unique air motor drive assembly 114 in accordance with the present disclosure fastened thereto for engaging the closed slots in the ladder surface of the guide rail to which the carriage, 122 or 124, is attached. The air motor drive assemblies 114 are each interchangeable between carriages 122 and 124 and are replaceable. Each of the assemblies 114 can be oriented in a locked position on the carriage or tilted to an unlocked position as shown in FIGS. 6 and 7 to permit installation of the carriages 122 or 124 on their respective rails 104 and 108. In the locked position, the spur gears 120 of the air motor drive assemblies 114 engage the closed slots in the ladder surface of the guide rail 104, 108. Furthermore, they are easily separated from the carriage 122, 124 to which they are mounted simply by removal of two pins.

Figure 4:
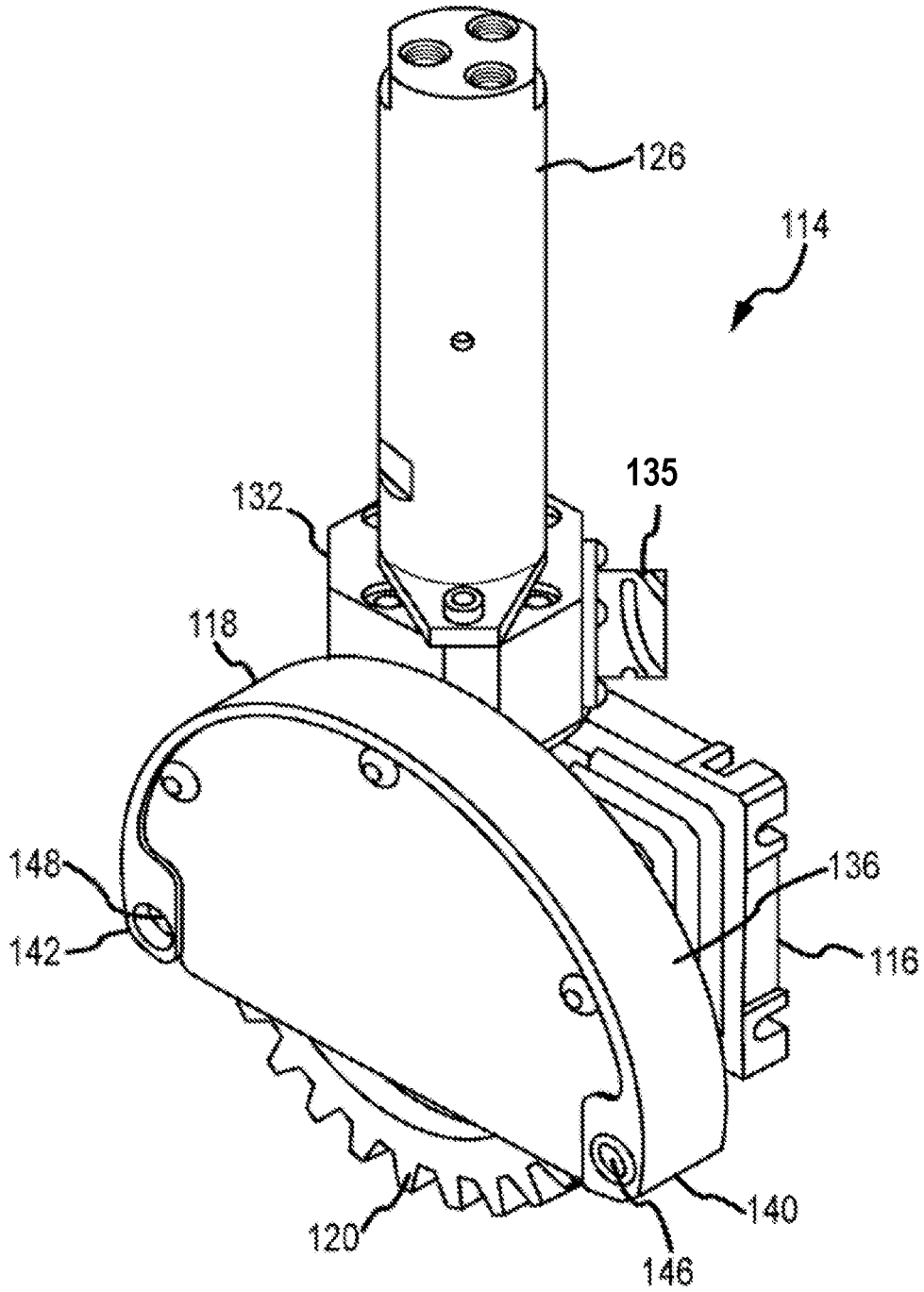
FIG. 4 is a separate perspective view of the air motor drive assembly in accordance with the present disclosure.
Figure 5:
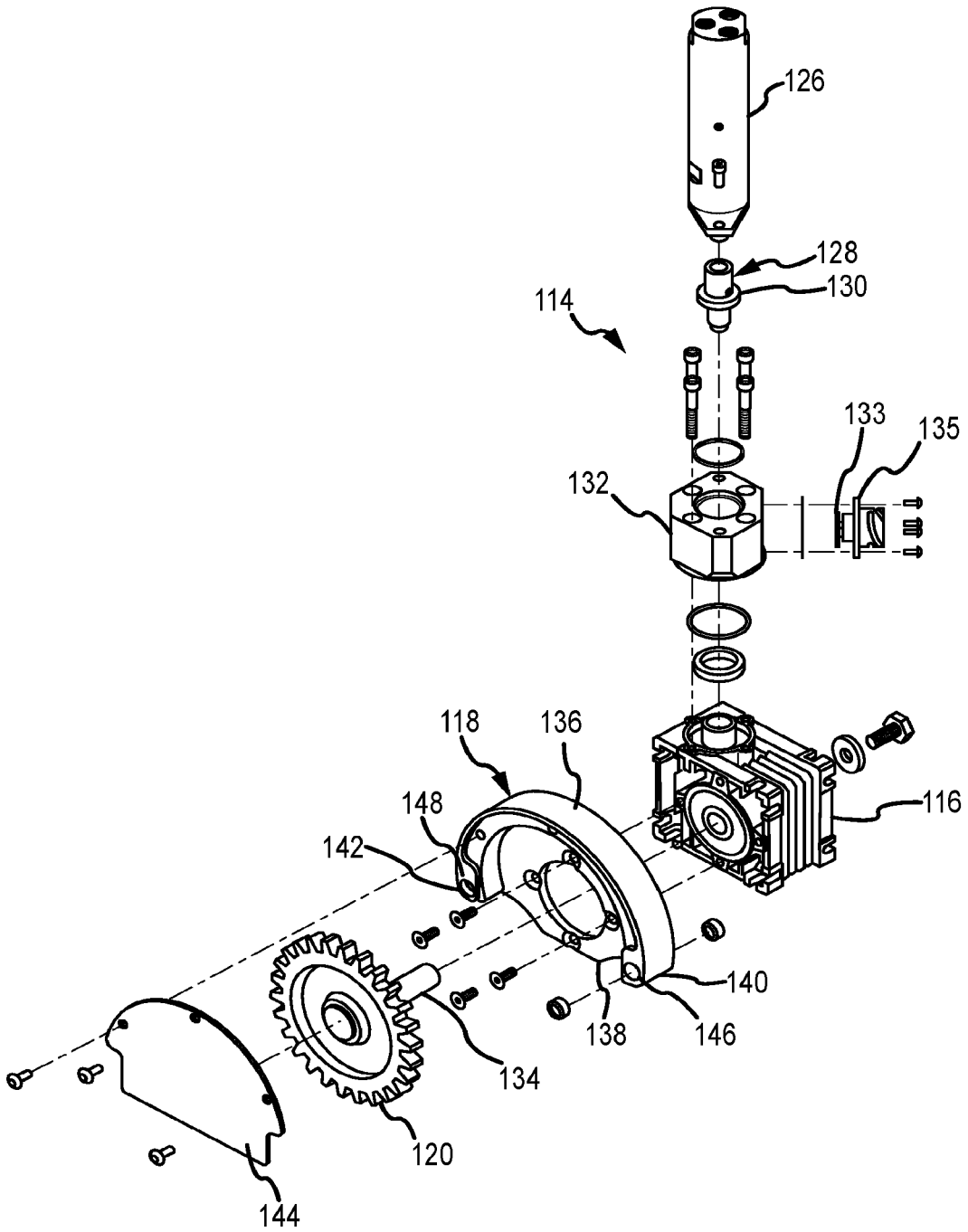
FIG. 5 is an exploded view of the air motor drive assembly in accordance with the present disclosure.

A separate perspective view of one of the air motor drive assemblies 114 is shown in FIG. 4. An exploded view of the air motor drive assembly 114 is shown in FIG. 5. The air motor drive assembly 114 includes an air motor 126 having a cylindrical shape driving a step shaft 128 to which is mounted a multipole magnet ring 130. The step shaft 128 and multipole ring 130 fit through an annular position sensor housing 132 with the step shaft 128 extending into a worm gear reducer gearbox 116. One exemplary gearbox 116 is a Montevario gearbox. The output shaft of the worm gear reducer gearbox 116 turns a spur gear shaft 134 that is keyed to the spur gear 120. The spur gear 120 is housed within a D shaped hollow spur gear housing 118 fastened to the gearbox 116. Preferably about a third of the spur gear teeth extend out through the straight open side of the D shaped housing 118.

A detector circuit board 133 is fastened to a bayonet connector 135 which is in turn fastened to the outer surface of the position sensor housing 132. One embodiment of this detector circuit board 133 carries a hall effect sensor that picks up magnetic pole transitions of the multipole magnet ring 130 as the air motor 126 rotates the step shaft 128 and thereby rotates the multipole magnet ring. This circuit board 133 is preferably part of the bayonet connector 135. A cable (not shown) is fastened to the bayonet connector 135 to transmit the sensed magnetic pole transitions to a processor for signal processing of the transitions into signals indicative of the precise position of the carriage 122 or 124 on the rail 104 or 108 respectively. These signals are in turn utilized to track flexible lance drive apparatus position with respect to the tube sheet 102.

This D shaped hollow spur gear housing 118 has an arcuate portion 136 and a straight portion 138 that join at corners 140 and 142. A generally D shaped cover plate 144 is fastened to the outer surface of the housing 118 to partially enclose the spur gear 120 therein. The D shaped housing 118 has a cross bore 146 therethrough adjacent corner 140 and another cross bore 148 therethrough adjacent corner 142. This spur gear housing 118 hides the spur gear 120 from external contact by a user and shields the assembly 114 from entry of debris and detritus expelled from heat exchanger tubes during use.

Referring now to FIG. 2, a separate perspective view of the positioner support rail carriage 122 is shown. The positioner support rail carriage 122 has a rectangular base plate 150. Four support rollers 156 are rotatably fastened to the bottom of the base plate 150. These rollers 156 roll along the ribs of the upper rail 104 when the carriage 122 is mounted on the upper rail 104 as shown in FIG. 1. The base plate 150 has a rectangular cutout 154 therethrough. A first U shaped support block 158 and a second U shaped support block 160 are fastened to the top of the base plate 150 so as to open toward each other over the rectangular cutout 154.

Support block 158 has a single cross bore receiving a retaining pin 162 that passes through both the block 158 and the corner bore 142 of the D shaped housing 118. Support block 160 has a first cross bore 164 complementarily positioned to the retaining pin 162. This cross bore 164 corresponds to the spur gear housing 118 being flush with the upper surface of the base plate 150 over the cutout 154 so as to hide the teeth of the spur gear 120, as is shown in FIG. 2. A removable pin 166 is shown in FIG. 2 locking the spur gear housing 118 and hence the air motor assembly 114 in a down position so as to engage the spur gear 120 with the rail 104 on which the carriage 122 rolls. The support block 160 has a second cross bore 168 therethrough spaced directly above the cross bore 164. This cross bore 164 receives the pin 166 through the bore 148 of the housing 118 to maintain the air motor assembly 114 out of engagement with the rail 104 as is shown in FIG. 7. Turning back to FIG. 2, the carriage 122 also has a support plate 152 fastened at a right angle to one end of the base plate 150. This support plate 152 carries a positioner drive rail clamp 169 that securely holds one end of the lance positioner support rail 108 in a position such as is shown in FIG. 1.

Figure 3B:
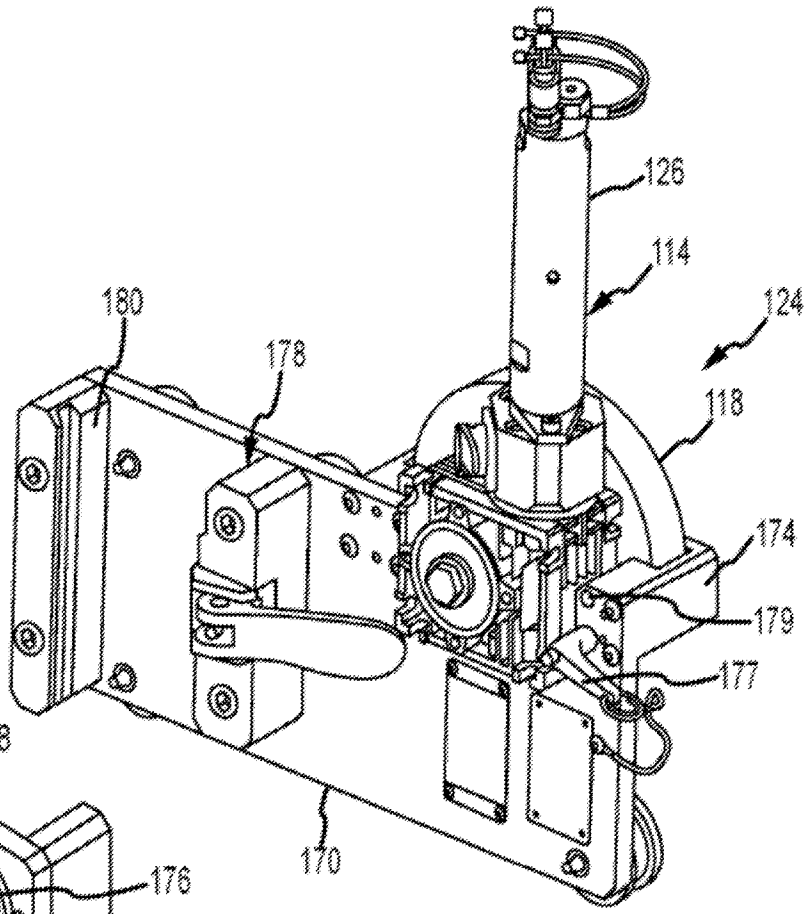
FIG. 3B is a right perspective view of the lance drive carriage assembly shown in FIG. 3A.
Figure 3A:
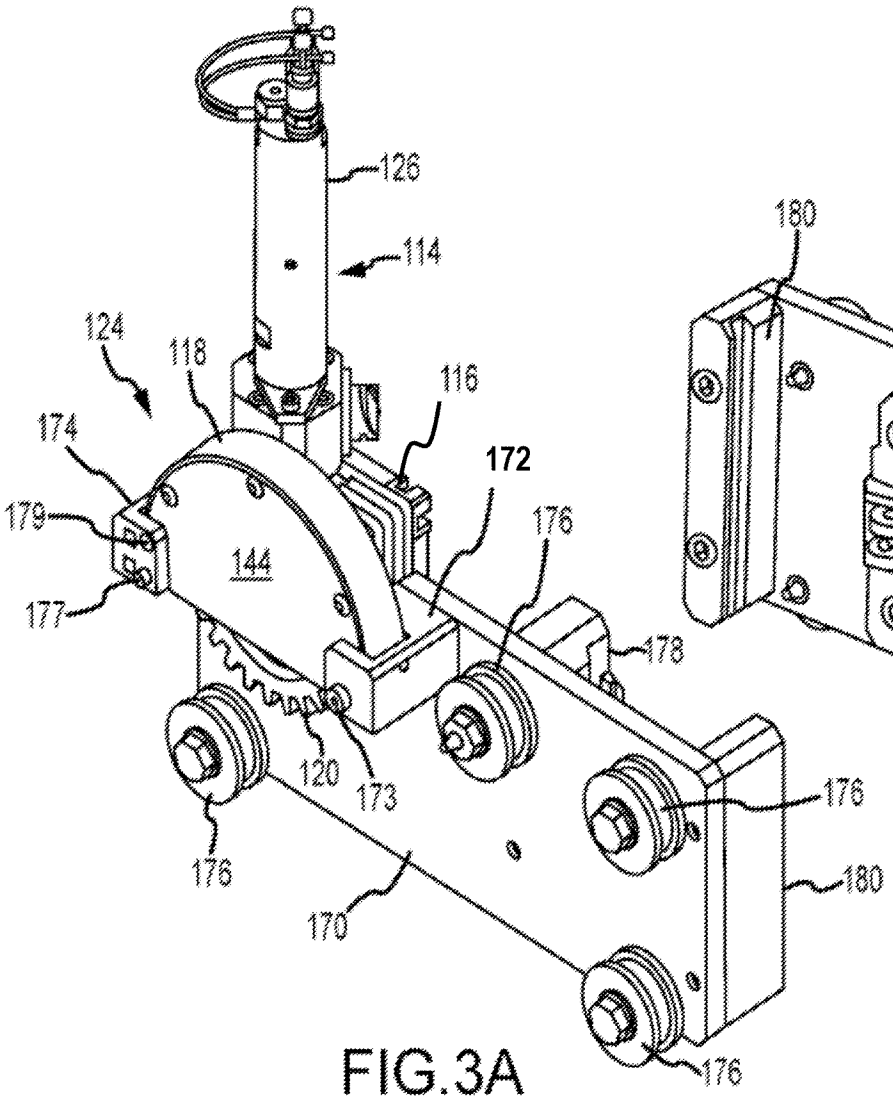
FIG. 3A is a left perspective view of a lance drive carriage assembly shown in FIG. 1.

Turning now to FIGS. 3A and 3B, left and right views of the flexible lance positioner carriage 124 are shown. This carriage 124 includes a base plate 170 to which, on one side, four guide rollers 176 are mounted for riding on and guiding the carriage 124 along support rail 108. Also mounted to the same side of the base plate 170 are U shaped first and second support blocks 172 and 174. These support blocks 172 and 174 open toward each other and receive the D shaped spur gear housing 118 therebetween so that the spur gear 120 extends into the ladder shaped slots in the support rail 108. One of the support blocks 172 has a single cross bore carrying a pivot pin 173 that extends through the cross bore 146 in the corner 140 of the spur gear housing 118. (See FIG. 4). This pin 173 provides a pivot for the air motor assembly 114. The other U shaped support block 174 has a first through bore 175 receiving removable pin 177 to lock the air motor assembly 114 into engagement with the rail 108 in the position as shown in FIGS. 3A and 3B. As with the carriage 122, the air motor assembly 114 may be pivoted about pin 173 when removable pin 177 is withdrawn and repositioned in the second, upper cross bore 179 as is shown in FIG. 6, permitting the carriage 124 to be rolled onto and along the rail 108 without engaging the teeth of spur gear 120 with the ladder slots in the rail 108.

Fastened to the other side of the base 170 of carriage 124 is a fixed clamp 180 and movable clamp 178 for removably capturing and clamping the flexible lance drive device (not shown) to the carriage 124. This flexible lance drive device may be a one, two or three lance drive such as StoneAge's ProDrive, ABX2L or one of StoneAge's ABX3L drives.

Figure 8:
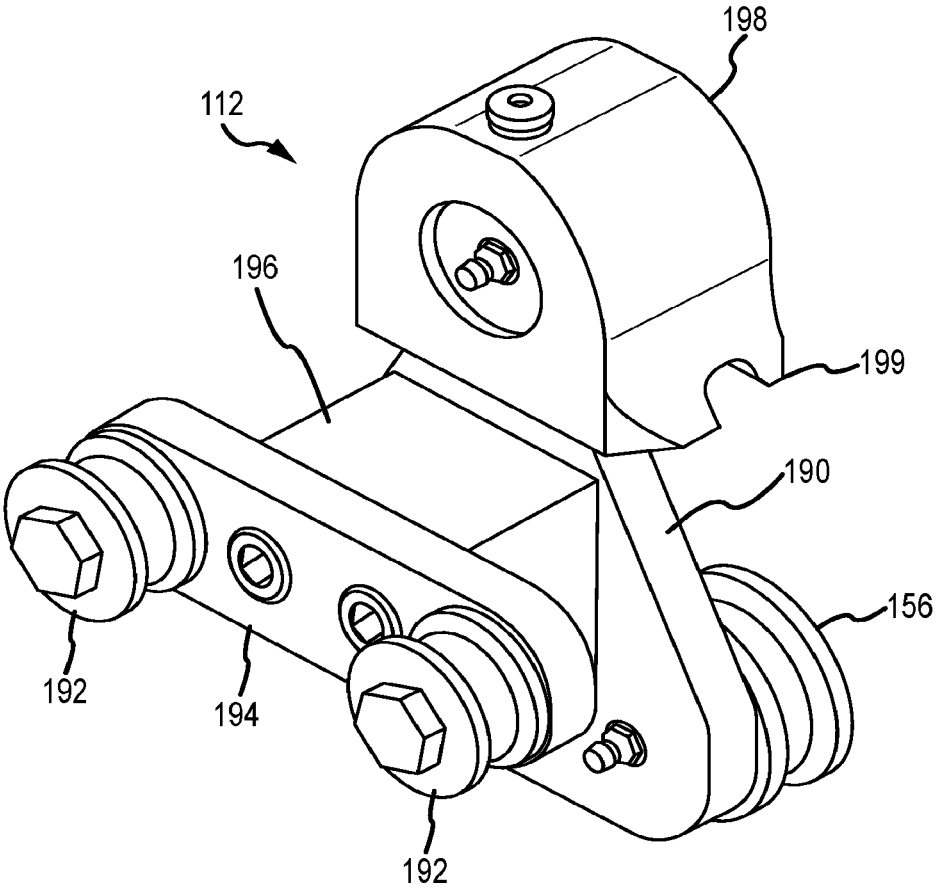
FIG. 8 is a separate perspective view of the lower guide rail follower roller carriage assembly in accordance with the present disclosure.

FIG. 8 is a separate perspective view of the lower guide rail follower roller carriage assembly 112 shown in FIG. 1. This follower roller carriage assembly 112 has an inverted generally Y shaped base plate 190 carrying three rollers 156, one on each leg of the Y shaped base plate 190. These rollers 156 roll along the lower rail 106 and prevent outward movement of the assembly 112 away from the rail 106. On the opposite side of the base plate 190 are a pair of guide rollers 192 fastened to an elongated support member 194 which is spaced from the base plate 190 by a spacer block 196. These guide rollers 192 are spaced to capture the lower end portion of the support rail 108 therebetween. The guide rollers 192 prevent outward movement of the support rail 108 while at the same time permitting vertical movement of the support rail 108 between the rollers 192 to compensate for non-parallel alignment between the upper rail 104 and lower rail 106. Fastened to the top of the inverted Y shaped base plate 190 is a cup shaped hollow scraper hood 198 arranged to cover the upper end of the base plate 190 and the upper roller 156. Its lower edge 199 scrapes along the top of the rail 106 (See FIG. 1) carried between the three rollers 156. This scraper hood 198 deflects debris expelled from the heat exchanger tubes while they are being cleaned and prevents the debris from accumulating on the rail 106 and interfering with the upper roller 156 fastened to the base plate 190. This ensures that the assembly 112 remains free to roll along the rail 106 as the rail 108 is translated back and forth over the tube sheet 102.

Many changes may be made to the apparatus described above, which will become apparent to a reader of this disclosure. For example, the rotation position sensor 132 may be other than as specifically described above. The multipole magnetic ring 130 and the sensor 133 could alternatively be mounted to the shaft 134 of the spur gear 120 or incorporated into one of the roller assemblies 156 or 176 instead of directly mounted to the step shaft 128 of the air motor 126 as shown. Alternatively, the air motor assembly 114 may be configured to linearly slide into and out of the support blocks 172, 174 and 158 and 160 rather than pivot as described above. Many other changes will become apparent to a reader given the disclosure above.

All such changes, alternatives and equivalents in accordance with the features and benefits described herein, are within the scope of the present disclosure. Such changes and alternatives may be introduced without departing from the spirit and broad scope of my invention as defined by the claims below and their equivalents.

What is claimed is:

1. A frame apparatus for holding a flexible lance positioning and drive device adjacent to and spaced from a heat exchanger tube sheet, the apparatus comprising:

a guide rail;

a positioner support rail supported from the guide rail; and a positioner support rail carriage movably mounted on the guide rail;

a flexible lance drive support carriage movably mounted on the positioner support rail; and an air motor drive assembly fastened to the positioner support rail carriage and an air motor drive assembly fastened to the flexible lance drive support carriage, each air motor drive assembly comprising an air motor having an air motor shaft driving a gear reducer that drives a spur gear in a spur gear housing fastened to one of the flexible lance drive support carriage and the positioner support rail carriage, wherein:

each spur gear housing is selectively rotatable between a locked position and an unlocked position, the spur gear of the positioner support rail carriage engages the guide rail in the locked position and disengages the guide rail in the unlocked position, and the spur gear of the flexible lance drive support carriage engages the positioner support rail in the locked position and disengages the positioner support rail in the unlocked position.

2. The frame apparatus according to claim 1 wherein the air motor shaft is coupled to a sensor sensing rotary position of the air motor shaft from which spur gear position and hence carriage position on the one of the guide rails may be calculated.

3. The frame apparatus according to claim 2 wherein the air motor shaft is connected to a multipole magnetic ring carried within a sensor housing fastened to the air motor.

4. The frame apparatus according to claim 2, wherein the gear reducer is a worm gear reducer, and wherein the sensor includes a step shaft carrying a multipole magnetic ring within a sensor housing fastened between the air motor and the worm gear reducer and a detector fastened to the sensor housing, wherein the detector includes a hall effect transducer configured to transmit pole reversals sensed from the multipole magnetic ring.

5. The frame apparatus according to claim 1, wherein:

the positioner support rail carriage comprises a pair of U shaped blocks spaced apart to receive the spur gear housing of the positioner support rail carriage, and the flexible lance drive support carriage comprises a pair of U shaped blocks spaced apart to receive the spur gear housing of the flexible lance drive support carriage.

6. The frame apparatus according to claim 5 wherein each U shaped block from each of the pairs of U shaped blocks of the positioner support rail carriage and the pair of U shaped blocks of the flexible lance drive support carriage has a first cross bore therethrough carrying a pin through the corner portion of the spur gear housing therein.

7. The frame apparatus according to claim 6 wherein one U shaped block from each of the pairs of U shaped blocks has a second cross bore therethrough spaced above the first cross bore and the pin through the first cross bore is removable to permit the spur gear housing to be rotated about the other U shaped block until the removable pin can be inserted through the second cross bore thereby lifting the spur gear out of engagement with the rail to which the carriage is mounted.

8. The frame apparatus according to claim 1 wherein the spur gear housing has a side cover adapted to prevent entry of debris into the spur gear during operation of the air motor drive assembly.

9. A frame apparatus for holding a flexible lance drive device adjacent to and spaced from a heat exchanger tube sheet, the frame apparatus comprising:

a guide rail;

a positioner support rail supported from the guide rail; and a positioner support rail carriage movably mounted on the guide rail;

a flexible lance drive support carriage movably mounted on the positioner support rail; and an air motor drive assembly fastened to each of the positioner support rail carriage and the flexible lance drive support carriage, each air motor drive assembly comprising an air motor having a shaft driving a gear reducer that drives a spur gear in a spur gear housing fastened to one of the flexible lance drive support carriage and the positioner support rail carriage, wherein;

the spur gear housing of the positioner support rail carriage is selectively transitionable between a locked position with the spur gear of the positioner support rail carriage engaging the guide rail and an unlocked position with the spur gear of the positioner support rail carriage disengaged with the guide rail, and the spur gear housing of the flexible lance drive support carriage is selectively transitionable between a locked position with the spur gear of the flexible lance drive carriage engaging the positioner support-a rail and an unlocked position with the spur gear of the flexible lance drive support carriage disengaged with the positioner support rail.

10. The frame apparatus according to claim 9 wherein the shaft is coupled to a sensor sensing rotary position of the shaft from which spur gear position and hence carriage position on the rail may be calculated.

11. The frame apparatus according to claim 10 wherein the shaft is connected to a multipole magnetic ring carried within a sensor housing fastened to the air motor.

12. The frame apparatus according to claim 10, wherein the gear reducer is a worm gear reducer, and wherein the sensor sensing rotary position includes a step shaft carrying a multipole magnetic ring within a sensor housing fastened between the air motor and the worm gear reducer and a detector fastened to the sensor housing.

13. The frame apparatus according to claim 12 wherein the detector includes a hall effect transducer configured to transmit pole reversals sensed from the multipole magnetic ring.

14. The frame apparatus according to claim 9, wherein:

the positioner support rail carriage comprises a pair of U shaped blocks spaced apart to receive the spur gear housing of the positioner support rail carriage, and the flexible lance drive support carriage comprises a pair of U shaped blocks spaced apart to receive the spur gear housing of the flexible lance drive support carriage.

15. The frame apparatus according to claim 14 wherein each U shaped block from each of the pairs of U shaped blocks of the positioner support rail carriage and the flexible lance drive support carriage has a first cross bore therethrough carrying a pin through the corner portion of the spur gear housing therein.

16. The frame apparatus according to claim 15 wherein one U shaped block from each of the pairs of U shaped blocks has a second cross bore therethrough spaced above the first cross bore and the pin through the first cross bore is removable whereby when the pin through the first cross bore is removed and repositioned into the second cross bore the spur gear housing is raised so that the spur gear is disengaged with the rail.

17. The frame apparatus according to claim 9 wherein the spur gear housing of each of the positioner support rail carriage and the flexible lance drive support carriage includes a side cover adapted to prevent entry of debris during operation of the air motor drive assembly.

* * * * *